US010690338B2

(12) United States Patent
Chen

(10) Patent No.: US 10,690,338 B2
(45) Date of Patent: Jun. 23, 2020

(54) METALLIC WICK

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 248 days.

(21) Appl. No.: 15/863,195

(22) Filed: Jan. 5, 2018

(65) Prior Publication Data

US 2018/0128481 A1 May 10, 2018

Related U.S. Application Data

(63) Continuation of application No. 13/740,328, filed on Jan. 14, 2013, now Pat. No. 9,885,474.

(30) Foreign Application Priority Data

Jun. 12, 2012 (TW) ..... 101120982 A
Sep. 26, 2012 (TW) ..... 101135343 A

(51) Int. Cl.

| | |
|---|---|
| ***F23D 3/08*** | (2006.01) |
| ***F21V 37/00*** | (2006.01) |
| ***F23D 3/18*** | (2006.01) |
| ***C11C 5/00*** | (2006.01) |
| *F21S 13/12* | (2006.01) |

(52) U.S. Cl.

CPC ..... *F23D 3/08* (2013.01); *C11C 5/006* (2013.01); *F21V 37/002* (2013.01); *F21V 37/0008* (2013.01); *F23D 3/18* (2013.01); *F21S 13/12* (2013.01)

(58) Field of Classification Search

CPC .. A47J 36/24; A47J 36/30; A47J 36/26; A47J 36/2477; F21V 37/002; F21V 37/0008; F23D 3/24; F23D 3/08; F23D 3/18; A61L 9/037; C11C 5/006; F21S 13/12

USPC ..... 431/321

See application file for complete search history.

(56) References Cited

U.S. PATENT DOCUMENTS 29,831 A * 8/1860 Smith ..... F23D 3/00 431/310
158,700 A * 1/1875 Gleason ..... F23D 3/18 431/321
190,879 A * 5/1877 Lewars ..... F23D 3/18 431/321

(Continued)

FOREIGN PATENT DOCUMENTS

GB 577728 5/1946
GB 577728 A * 5/1946 ..... F21V 37/00

(Continued)

*Primary Examiner* — Jorge A Pereiro

(74) *Attorney, Agent, or Firm* — Alan D. Kamrath; Karin L. Williams; Mayer & Williams PC

(57) ABSTRACT

A metallic wick includes at least one mesh member having first and second ends disposed opposite to each other, first and second surfaces respectively extended from the first end to the second end thereof and arranged opposite to each other, a plurality of meshes penetrating the first and second surfaces between the first and second ends thereof; and a transport channel extending from the first end to the second end thereof and drawing fuel by capillary action.

12 Claims, 20 Drawing Sheets

(56) References Cited

U.S. PATENT DOCUMENTS 1,267,475 A * 5/1918 Strobl ..... F23Q 2/06 431/146
1,522,323 A * 1/1925 Olsson ..... F23D 3/00 431/310
1,693,604 A * 12/1928 Heldrich ..... F21V 37/00 431/325
1,901,834 A * 3/1933 Barger ..... F23D 3/00 431/298
1,922,940 A * 8/1933 Franck ..... D21F 1/14 245/10
1,983,372 A * 12/1934 Horsley ..... F21L 17/00 431/310
2,013,442 A * 9/1935 Hughes ..... F21V 37/00 431/325
2,190,928 A * 2/1940 Rudolph ..... F23D 3/00 431/146
2,376,083 A 5/1945 Quinn
2,441,242 A * 5/1948 Harkins ..... F21L 17/00 431/154
2,817,226 A * 12/1957 Dickman ..... F21L 17/00 431/146
3,121,316 A * 2/1964 Wilson ..... F23D 3/16 431/206
3,214,375 A * 10/1965 Berkeley ..... F21V 37/0025 508/216
3,262,290 A * 7/1966 Huber ..... F23Q 2/52 431/328
3,397,686 A 8/1968 Jones
3,652,197 A * 3/1972 Tokarz ..... F21V 37/00 431/326
3,947,227 A * 3/1976 Granger ..... F23C 99/00 431/118
3,964,902 A * 6/1976 Fletcher ..... B22F 3/002 29/890.032
4,019,571 A * 4/1977 Kosson ..... F28D 15/046 165/104.26
4,496,307 A * 1/1985 Ginardi ..... F23Q 25/00 431/146
4,526,530 A * 7/1985 Menter ..... F21S 13/00 431/146
4,563,150 A * 1/1986 Nilsson ..... F21S 13/00 431/320
RE32,086 E * 2/1986 Spirig ..... B23K 3/08 228/19
4,728,286 A * 3/1988 Olsen ..... F21V 37/00 362/180
4,735,568 A * 4/1988 Izumisawa ..... F23D 3/08 431/298
4,774,032 A * 9/1988 Coates ..... A61M 16/18 128/204.13
4,896,653 A * 1/1990 Eke ..... A47J 36/30 126/43
4,911,139 A * 3/1990 Yost ..... A47J 36/30 126/45
5,193,521 A 3/1993 Levinson et al.
5,305,941 A 4/1994 Kent et al.
5,669,767 A * 9/1997 Bureau ..... F21V 37/00 422/125
5,797,739 A * 8/1998 Lioi ..... F23D 3/02 126/45
5,829,966 A * 11/1998 Stoner ..... F23D 3/02 431/320
5,967,769 A 10/1999 Thompson
6,250,912 B1 6/2001 Widdowson
6,270,340 B1 * 8/2001 Lepp ..... F23D 3/08 431/288
6,537,063 B1 3/2003 Pecoskie
6,708,897 B1 * 3/2004 Hart ..... A01M 1/2033 239/145
6,758,575 B2 * 7/2004 Winkler ..... A47G 19/30 362/154
6,766,817 B2 7/2004 da Silva
6,848,901 B1 * 2/2005 Matsuyama ..... F23D 3/18 431/310
7,396,444 B2 7/2008 Berndt
7,727,771 B2 6/2010 Chiou et al.
7,819,822 B2 10/2010 Calasso et al.
8,231,844 B2 7/2012 Gorfinkel et al.
8,338,187 B2 12/2012 DeRosier
8,420,024 B2 4/2013 Korner et al.
8,501,117 B1 8/2013 Bedair et al.
8,567,123 B2 10/2013 Friesen
2001/0004934 A1 * 6/2001 Yamamoto ..... F28D 15/0233 165/104.11
2003/0027092 A1 * 2/2003 Wolgamuth ..... F23D 3/24 431/345
2004/0061245 A1 * 4/2004 Maisotsenko ..... F02B 29/0462 261/153
2005/0218535 A1 * 10/2005 Maisotsenko ..... F02B 29/0462 261/153
2006/0102630 A1 * 5/2006 Cassol ..... B65D 77/2056 220/270
2007/0190472 A1 * 8/2007 Chen ..... F23D 3/18 431/320
2007/0197937 A1 8/2007 Sarofim et al.
2008/0090188 A1 * 4/2008 Pisklak ..... F23D 3/40 431/7
2008/0315011 A1 12/2008 Pesu
2010/0269881 A1 * 10/2010 Scheller ..... B32B 5/26 136/242
2011/0309157 A1 * 12/2011 Yang ..... A01M 1/2077 239/6
2011/0311876 A1 12/2011 Sturgeon et al.
2012/0024975 A1 2/2012 Sharma et al.
2012/0202160 A1 * 8/2012 Ford ..... F23D 3/08 431/289
2012/0214110 A1 * 8/2012 Cagle ..... F23D 3/16 431/291
2012/0264069 A1 * 10/2012 Ramirez ..... F23D 3/08 431/295
2013/0020059 A1 1/2013 Park
2013/0081582 A1 4/2013 Varga
2013/0081618 A1 4/2013 Korneff et al.
2013/0081620 A1 4/2013 Korneff et al.
2013/0081621 A1 4/2013 Korneff et al.
2013/0081622 A1 4/2013 Korneff et al.
2013/0081625 A1 4/2013 Rustad et al.
2013/0081701 A1 4/2013 Korneff et al.
2013/0255672 A1 10/2013 Varga et al.
2013/0284310 A1 10/2013 Peterson et al.
2013/0288186 A1 10/2013 White
2014/0209701 A1 * 7/2014 Cen ..... A61L 9/127 239/44

FOREIGN PATENT DOCUMENTS

GB 577728 9/1946
TW 493722 U 7/2002
TW 580106 U 3/2004

* cited by examiner

METALLIC WICK

CROSS REFERENCE TO RELATED APPLICATION

The present application is a continuation application of U.S. patent application Ser. No. 13/740,328 filed on Jan. 14, 2013.

BACKGROUND OF THE INVENTION

1. Field of the Invention

The present invention relates to a wick and, more particularly, to a wick made of metal and provided for being mounted to a lamp device for quickly igniting fuel.

2. Description of the Related Art

A conventional lamp device includes a fuel cup storing fuel, a high temperature resistant disk mounted on the fuel cup, and a wick inserted through the disk to connect with fuel stored in the fuel cup. Moreover, the wick is normally made out of braided cotton and works by capillary action. Fuel is drawn up through the wick to reach the flame produced on the disk. The above lamp device is actively used for various purposes, such as lighting, decorating, or increasing atmosphere. For example, an oil lamp is used in religion, or an alcohol lamp is used in medical or chemical laboratories.

The conventional cotton wick must be cut to a predetermined length adapted for being mounted to the lamp device. However, after trimming, the cotton wick is easily loosened at its terminal end to cause it to be difficult to insert through the disk. After ignition, fuel vaporizes and combusts on the wick, and the tip of the cotton wick will be carbonized and burnt out gradually on the tip due to a higher temperature on the top of flame. Thus, the cotton wick must be pulled out from the disk and trimmed to a certain length every once in a while to maintain a combustion scale. Trimming the cotton wick results in the wick eventually being unconnected with fuel, so that users can only replenish fuel or replace a new wick. It is inconvenient and wasteful.

The wick length, diameter, stiffness and fire-resistance are the major factors used to adjust fuel wicking and flame scale for the lamp device. However, cotton wicks with low stiffness and fire-resistance cannot be adjusted easily to maintain proper fuel wicking and flame scale. High viscosity or high flash point fuels result in carbon deposits being produced and are difficult to ignite. If the fuel drawn is slower than it burns, the wick will be carbonized and become burnt out. If the fuel drawn is more than it burns, usually occurring on burning high flash point fuel, slow evaporation of the fuel will be caused, producing soot due to incomplete combustion. Incomplete combustion not only produces soot but also toxic fumes.

Taiwan Patent No. 493,722 discloses a wick including a plurality of fiberglass filaments disposed and assembled at a center thereof to form a fiberglass layer, and a plurality of fiberglass yarns and melted silks arranged around the fiberglass layer. The fiberglass layer is able to draw fuel by capillary action, is hard to burn down, and is not easily loosened at its terminal end. However, the fiberglass layer does not draw fuel effectively causing the flame to extinguish easily, and the flame scale is difficult to be controlled. Moreover, Taiwan Patent No. 580,106 discloses a wick including a cotton thread enabling fuel to be drawn and a plurality of fiberglass filaments covering around the cotton thread to avoid the cotton thread from being loosened to provide a compound wick.

Therefore, the wick disclosed by said patents both include fiberglass filaments, but the fiberglass is expensive and difficult to process. The wick is a large quantity of consumable items, but the fiberglass wick is expensive and not environment-friendly. Additionally, when the fiberglass wick is processed, inhaling the fiberglass can cause damage to human lungs and can be harmful to manufacturing personnel. Inhaling of fiberglass will jeopardize the health of workers during fiberglass-reinforced plastic processing. The fiberglass fiber can also cause skin, eye and throat irritation to users. At higher exposure levels, fiberglass also has been associated with skin rashes and difficulty in breathing.

Likewise, a fiberglass wick will be carbonized and burned out during combustion, but only slower than cotton wick, so that the fiberglass wick needs be trimmed also. Furthermore, the fiberglass wick and the cotton wick are easy to sag due to gravity when they are saturated with fuel. Thus, the user cannot adjust the flame height or scale easily. If a user wants to adjust the flame height or scale, the user has to pull the wick out from the lamp device constantly. At the same time, the user may also contact fuel in the wick and cause inconvenience or even danger.

The present invention is, therefore, intended to obviate or at least alleviate the problems encountered in the prior art.

SUMMARY OF THE INVENTION

The present invention resolves these requirements and other problems in the field of a metallic wick including at least one mesh member having first and second ends disposed opposite to each other, first and second surfaces respectively extended from the first end to the second end thereof and arranged opposite to each other, a plurality of meshes penetrating the first and second surfaces between the first and second ends thereof; and a transport channel extending from the first end to the second end thereof drawing fuel by capillary action.

In an example, the metallic wick generally includes a mesh member rolled into a tubular shape and having a plurality of circles spaced from each other along a longitudinal axis to form an Archimedean spiral cross section perpendicular to the longitudinal axis.

In another example, the metallic wick includes a plurality of mesh members respectively rolled into the plurality of different-sized tubes assembled and radially spaced from each other along a longitudinal axis to form a concentric circular cross section perpendicular to the longitudinal axis.

In a further example, the metallic wick includes a plurality of mesh members spaced from each other and arranged in a longitudinal stacked array.

In a further example, the metallic wick includes a mesh member bent to form a stacked array.

Preferably, each of the plurality of meshes is formed in a quadrilateral shape, such as a square or rhombus.

Preferably, the mesh member is formed in a flat shape.

An advantage of the metallic wick according to the present invention is that the metallic wick cannot be carbonized or consumed to maintain a fixed height thereof to maintain the flame combustion scale.

Another advantage of the metallic wick according to the present invention is that the metallic wick includes an end producing the flame thereon and heated by the flame to cause fuel drawn to the end thereof to be vaporized and combusted more completely due to a higher wick temperature.

A further advantage of the metallic wick according to the present invention is that the number of circles, the size of meshes, the surface roughness and the coating materials of the mesh member are adjustable to control the ability of capillary action adapted for wicking various fuels with different viscosity, so that the metallic wick can draw more viscous fuel faster to the tip thereof and can be ignited shortly (one minute or less) after inserting the wick in fuel.

A further advantage of the metallic wick according to the present invention is that the metallic wick does not loosen at its terminal end after cutting a predetermined length or trimming to be mounted to a lamp device.

A further advantage of the metallic wick according to the present invention is that the metallic wick is made of metal, reducing manufacturing costs to provide a popular price. In a preferred form, the metallic wick can be formed by a common metal wire mesh.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
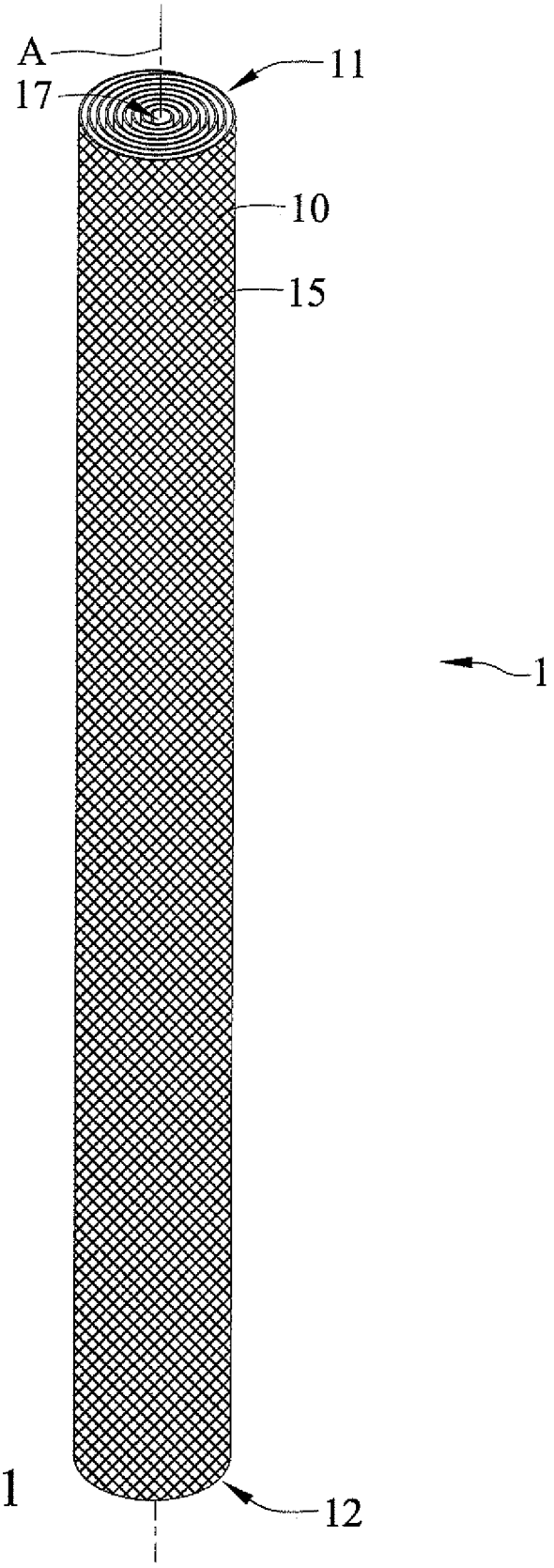
FIG. 1 shows a perspective view of a metallic wick of a first embodiment according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "longitudinal", "radial", "diameter", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE PREFERRED EMBODIMENTS

Figure 2:
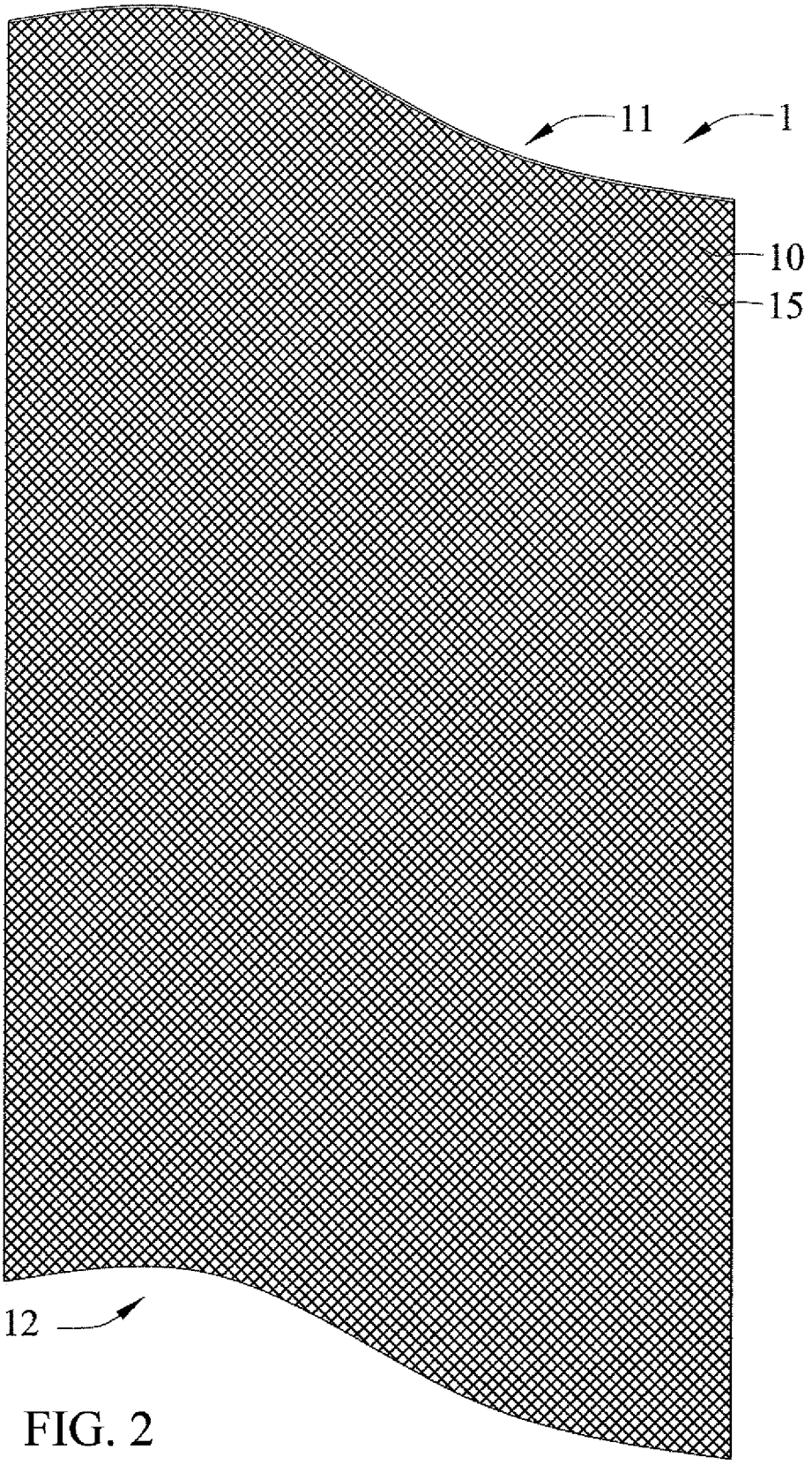
FIG. 2 shows an exploded, perspective view of the metallic wick of FIG. 1.
Figure 3:
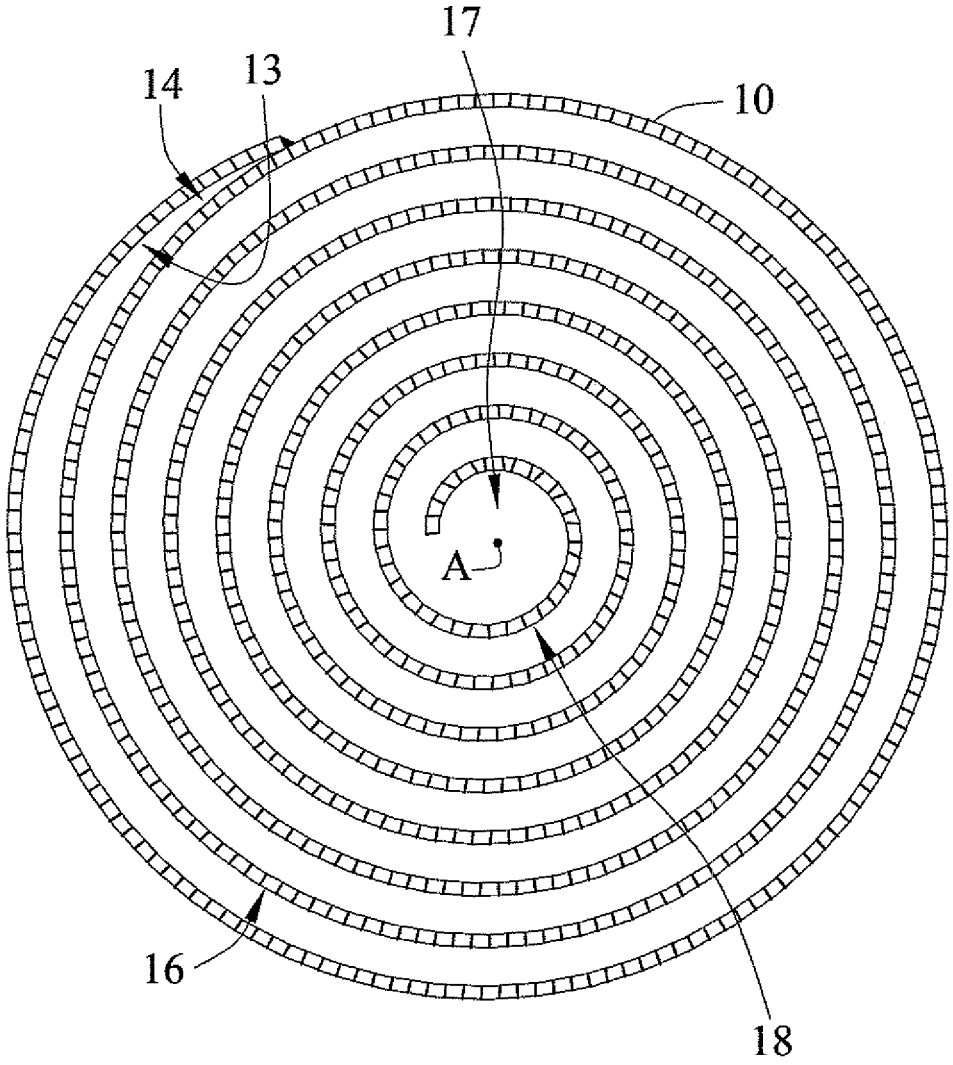
FIG. 3 shows a top view of the metallic wick of FIG. 1.

FIGS. 1 through 3 show a first embodiment of a metallic wick according to the present invention shown in the drawings. The metallic wick 1 generally includes a mesh member 10 made of metal and rolled into a tubular shape and having a plurality of circles spaced from each other along a longitudinal axis A to form an Archimedean spiral cross section perpendicular to the longitudinal axis A. The mesh member 10 includes first and second ends 11 and 12 disposed opposite to each other along the longitudinal axis A, and first and second surfaces 13 and 14 respectively extended from the first end 11 to the second end 12 thereof and arranged opposite to each other. Furthermore, the mesh member 10 essentially includes a plurality of metallic wires interlacing and overlapping each other to form into a plurality of meshes 15 penetrating the first and second surfaces 13 and 14 between the first and second ends 11 and 12 thereof. Each of the plurality of meshes 15 is formed in a quadrilateral shape, such as a square or rhombus. Moreover, the mesh member 10 has the plurality of circles winding around the longitudinal axis A at a continuously increasing radial distance from the longitudinal axis A to form a transport channel 16 extending from the first end 11 to the second end 12 thereof along the longitudinal axis A. The transport channel 16 includes a central section 17 disposed adjacent to the longitudinal axis A and an annular section 18 connected with and winding around the central section 17. The first surface 13 of the innermost one of the plurality of circles is arranged around the longitudinal axis A to form the central section 17. The first and second surfaces 13 and 14 of the other circles face each other, except the innermost one is defined with the annular section 18. The first surface 13 of the outermost one of the plurality of circles is connected with and abutted against the second surface 14 of the other circle arranged adjacent to the outermost one.

Figure 4:
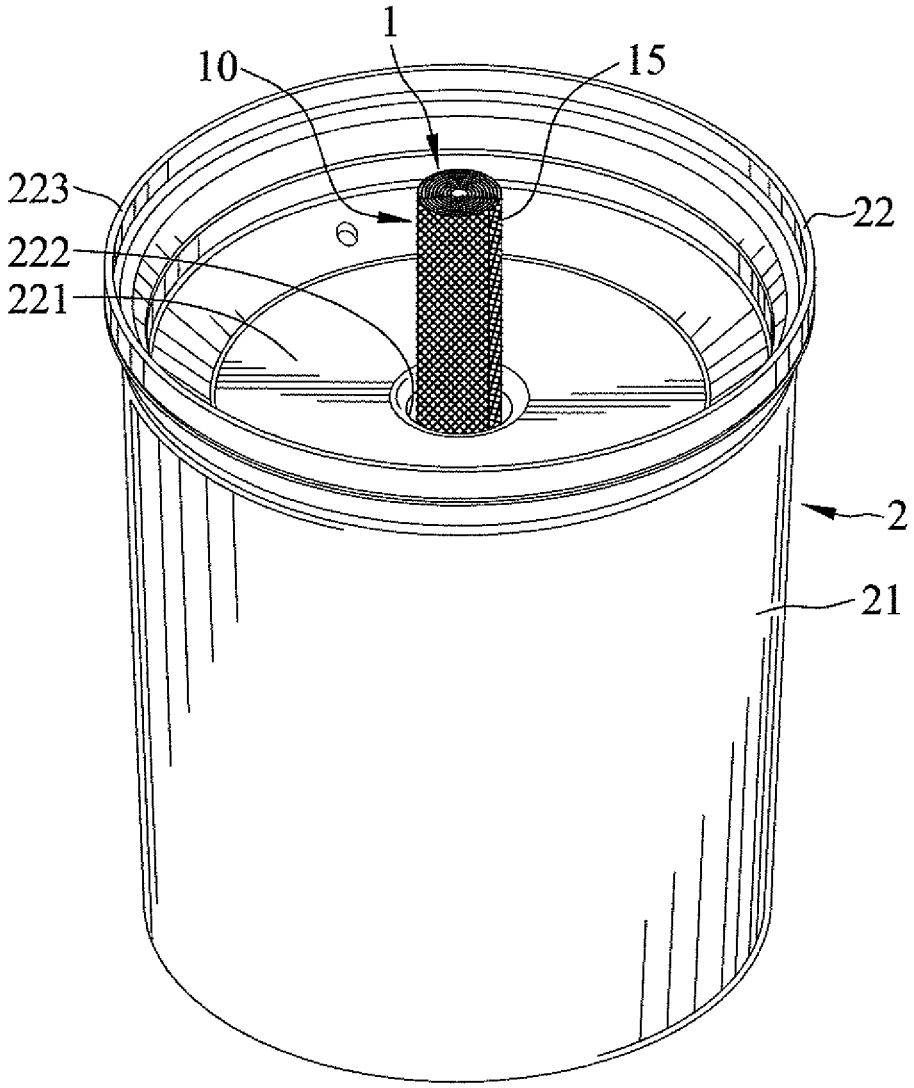
FIG. 4 shows a perspective view of the metallic wick of FIG. 1, and illustrates the metallic wick mounted to a lamp device.
Figure 5:
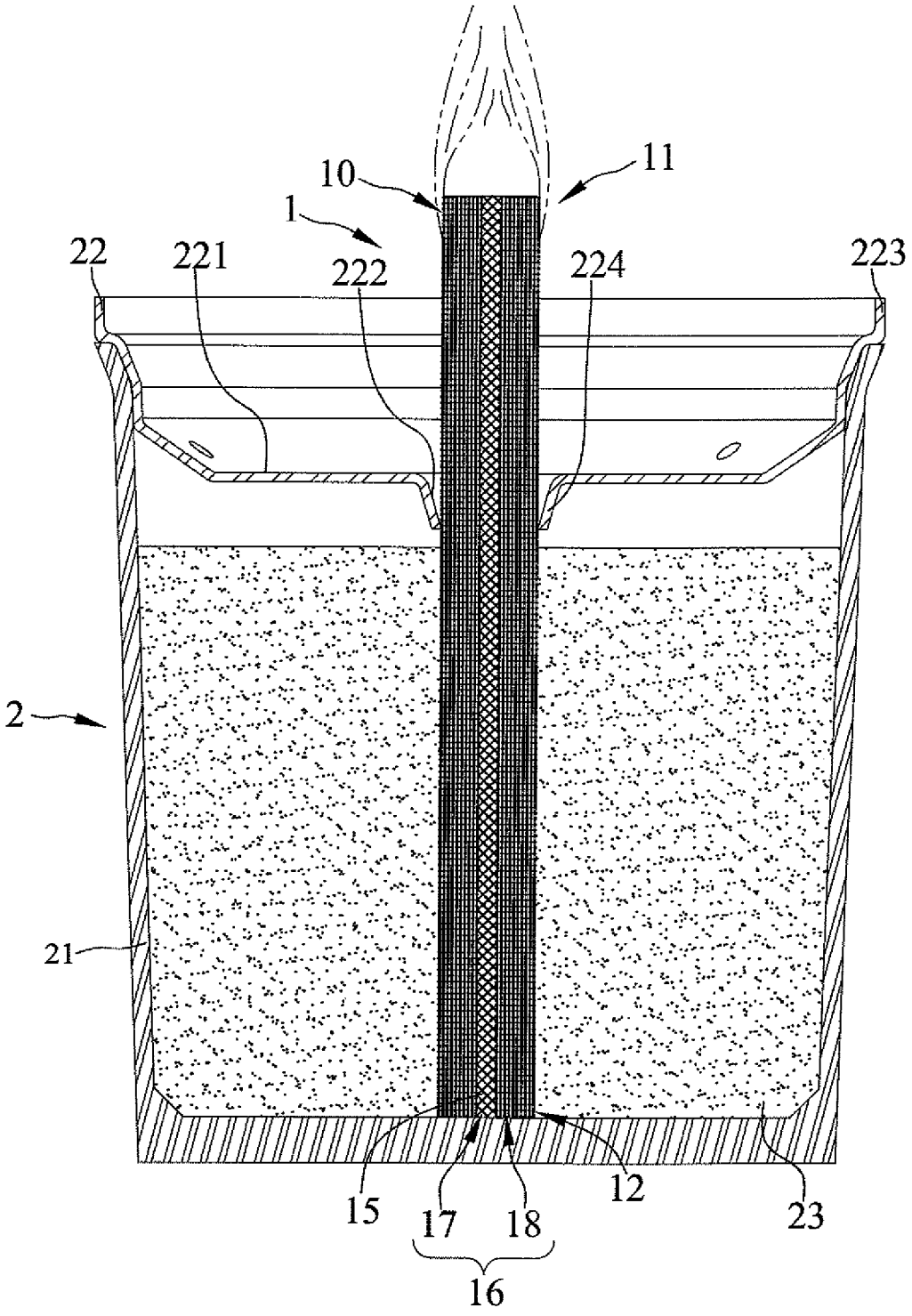
FIG. 5 shows a cross section view of FIG. 4.
Figure 6:
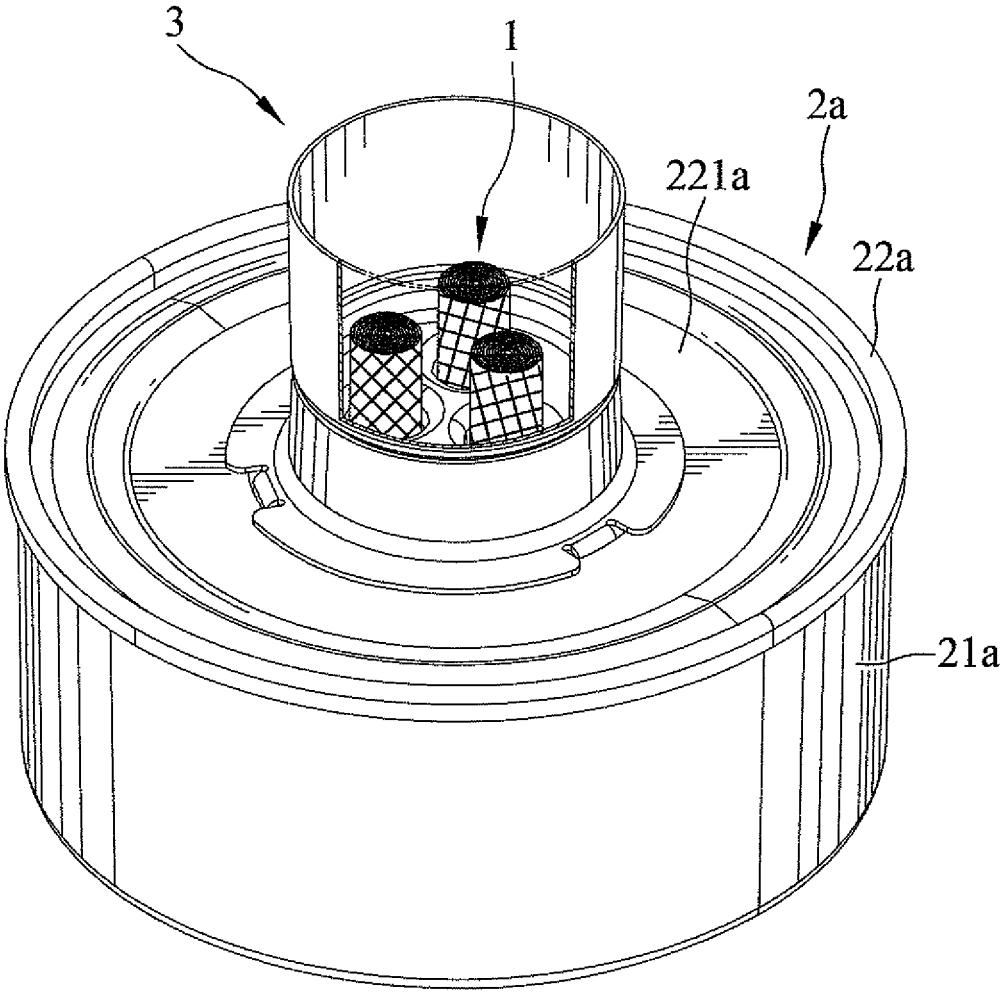
FIG. 6 shows a perspective view of the metallic wick of FIG. 1, and illustrates three metallic wicks mounted to another lamp device.
Figure 7:
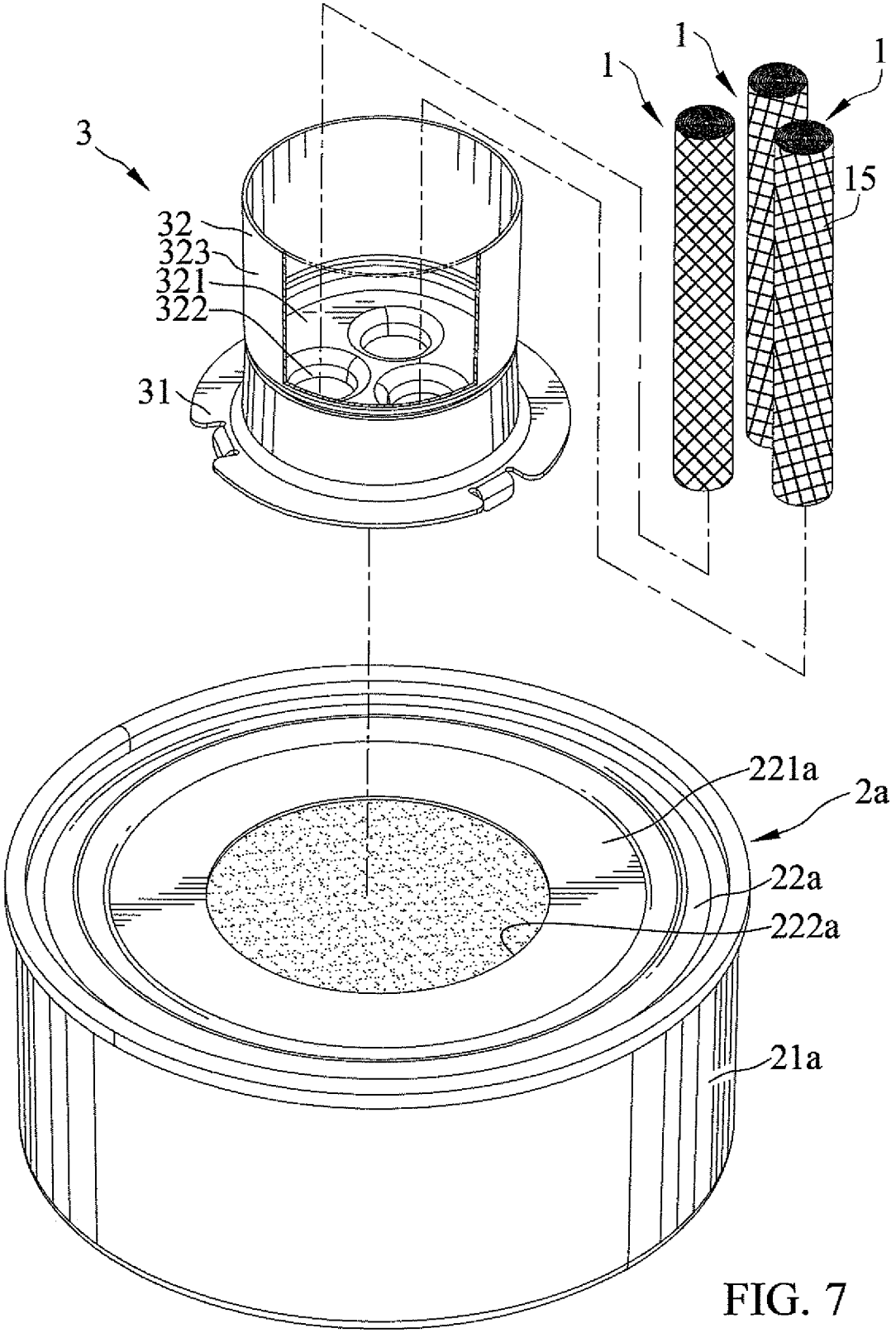
FIG. 7 shows an exploded, perspective view of the metallic wick of FIG. 6.
Figure 8:
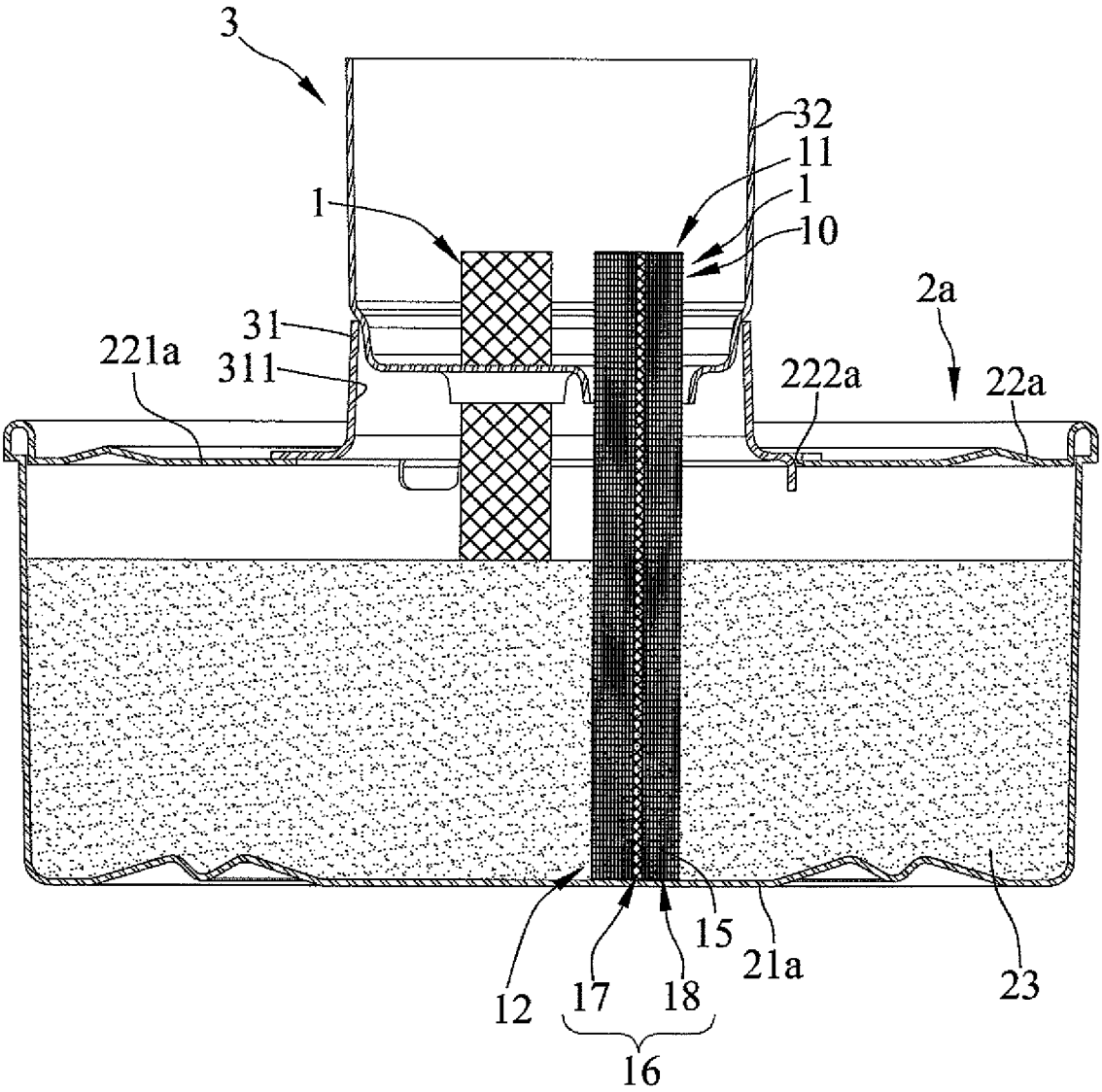
FIG. 8 shows a cross section view of FIG. 6.
Figure 9:
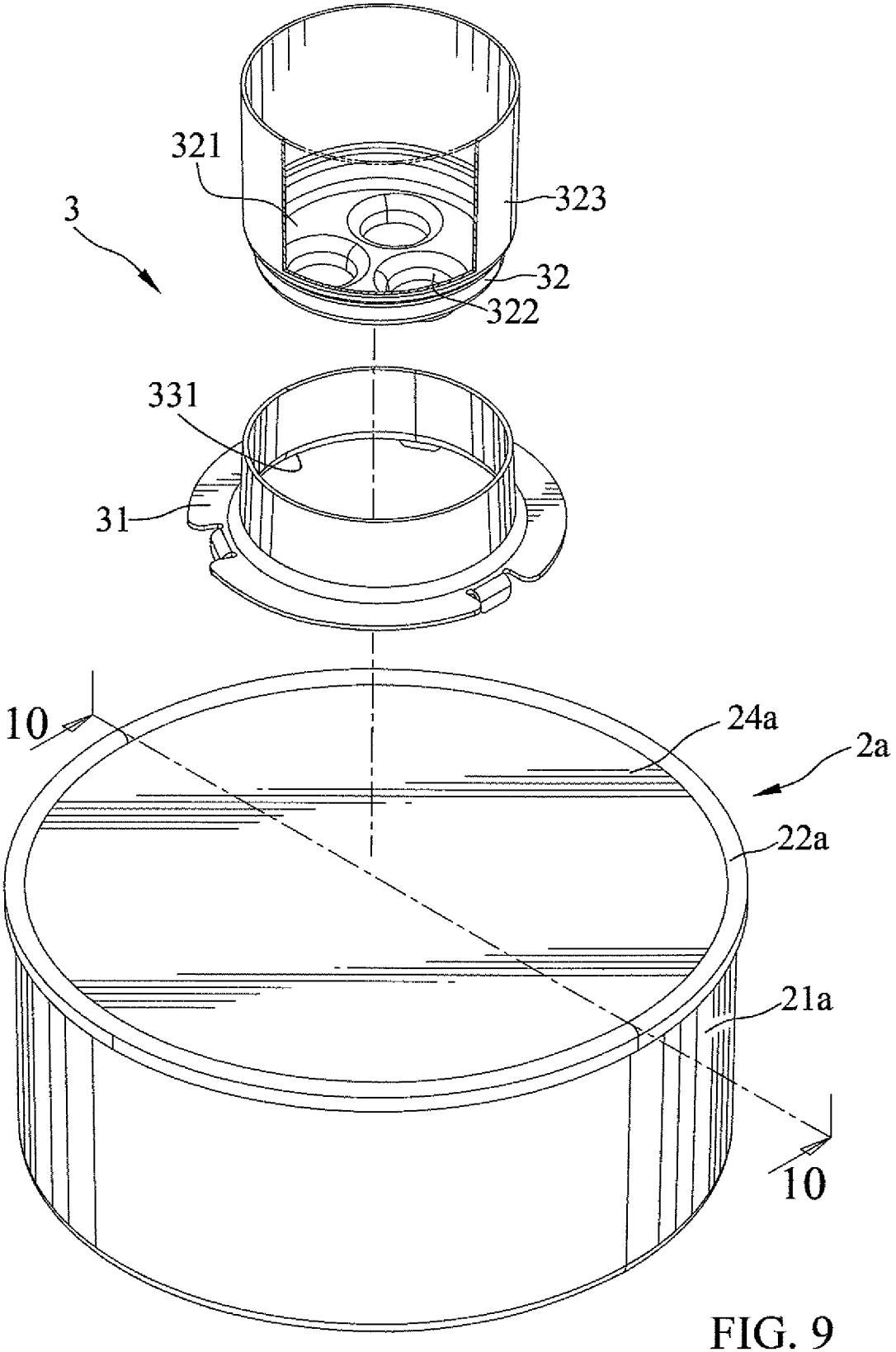
FIG. 9 shows an exploded, perspective view of the lamp device of FIG. 6.
Figure 10:
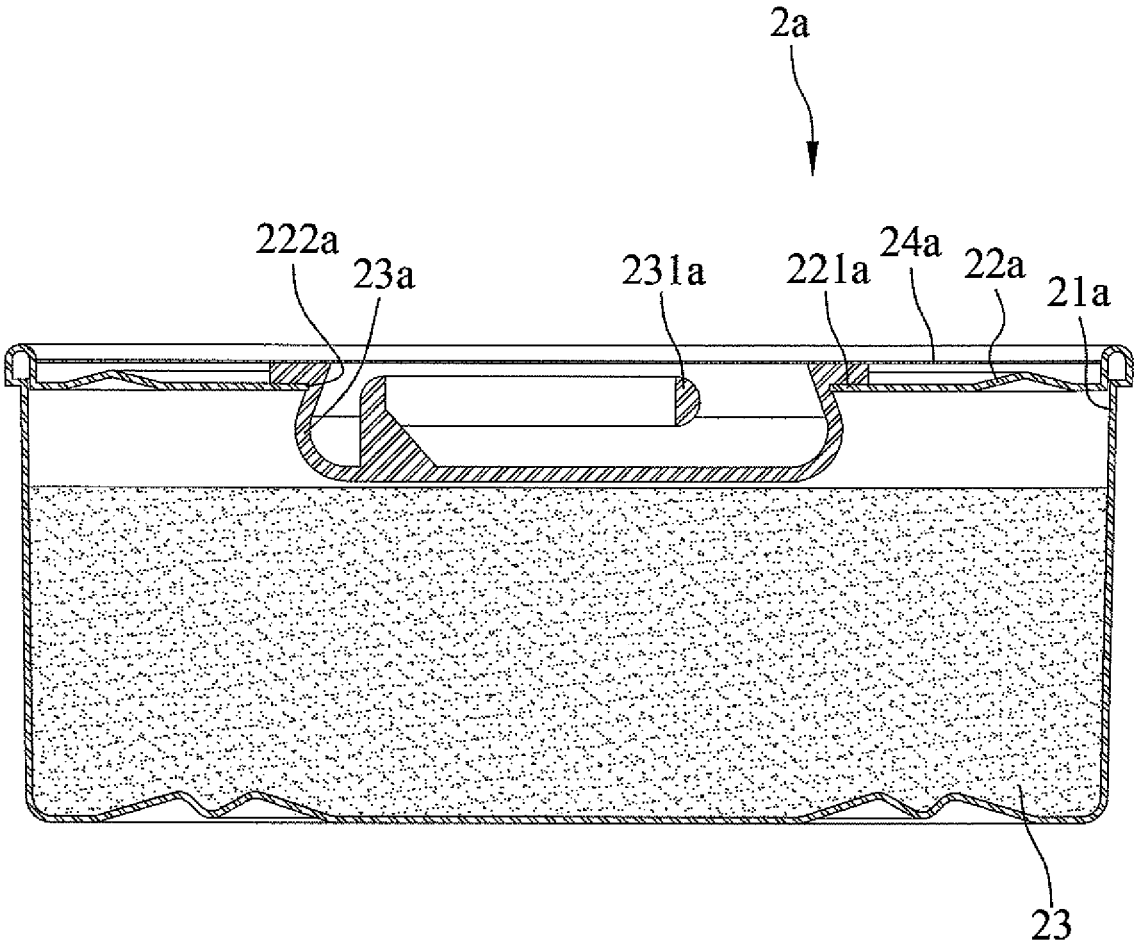
FIG. 10 shows a cross section view taken along line 10-10 of FIG. 9.
Figure 11:
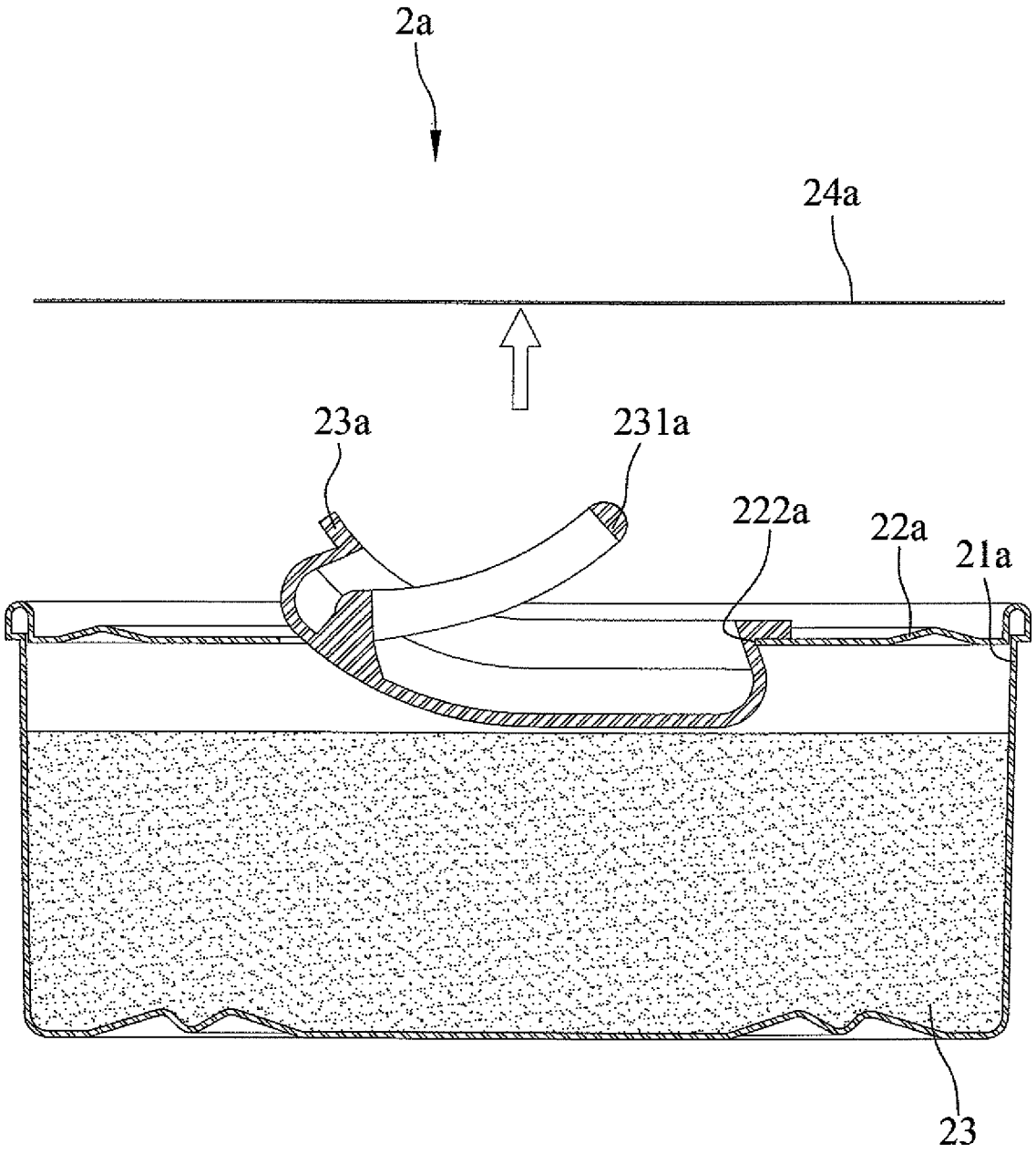
FIG. 11 shows a continued view of FIG. 10, and illustrates a film detached from a cap of the lamp device.

FIGS. 4 and 5 show the metallic wick 1 cut into a predetermined length and mounted to a lamp device 2. The lamp device 2 includes a fuel tank 21 and a cap 22 removably and adaptably mounted on an open end of the fuel tank 21. The cap 22 has an essentially circular cross section and includes a bottom portion 221, a through hole 222 longitudinally extending through the bottom portion 221, an annular wall portion 223 formed around a periphery of the bottom portion 221, and an abutted portion 224 formed around a periphery of the through hole 222 and extending opposite to the bottom portion 221. The metallic wick 1 is inserted through the through hole 222 of the cap 22 and connects with fuel 23 stored in the fuel tank 21. The bottom portion 221 hinders the flame produced at the first end 11 to ignite fuel 23. A diameter of the through hole 222 is equal to or bigger than a diameter of the cross section of the metallic wick 1 causing the mesh member 10 to maintain its tubular shape. The annular wall portion 223 provides a windproof function. The abutted portion 224 abuts against the metallic wick 1 to maintain the metallic wick 1 in an upright position. Thus, fuel 23 is drawn from the second end 12 to the first end 11 of the metallic wick 1 via the transport channel 16 by capillary action between the plurality of meshes 15 and the central and annular sections 17 and 18 to reach the flame produced at the first end 11 and then vaporizes and combusts. Moreover, the size of each of the plurality of meshes 15 is unchanged or only has a very small deformation when the mesh member 10 is rolled into the plurality of circles, so that appearance factors of the metallic wicks 1, such as height and diameter are practically unchanged. Thus, the metallic wicks 1 can precisely adjust and maintain the flame scale during combustion. Furthermore, the number and size of transport channel 16 can be adjusted to transfer fuel 23 quickly for fuel igniting, even for high viscosity fuels.

FIGS. 6 through 11 show three metallic wicks 1 respectively cut into a predetermined length and mounted to another lamp device 2*a*. The lamp device 2*a* includes a fuel tank 21*a* and a cap 22*a* formed integrally as a single piece. The cap 22*a* has an essentially circular cross section and includes a bottom portion 221*a* and a through hole 222*a* longitudinally extending through the bottom portion 221*a*. A pull tab 23*a* is removably and adaptably connected to and closes the through hole 222*a* to avoid fuel 23 leaking out of the fuel tank 21*a*. The pull tab 23*a* has a ring 231*a*. A film 24*a* is removably connected to one end of the cap 22*a* and opposite to the bottom portion 221*a*. A user can hook his/her finger through the ring 231*a* and can remove the pull tab 23*a* from the through hole 222*a*, so that the through hole 222*a* is interconnected with an open end of the fuel tank 21*a*.

The lamp device 2*a* further includes a supporting assembly 3 mounted on the cap 22*a*. The supporting assembly 3 includes a fixing member 31 and a shield member 32. The fixing member 31 is connected to the bottom portion 221*a* of the cap 22*a* and has a through bore 311 communicated with the through hole 222*a* of the cap 22*a*. The shield member 32 is mounted into the through bore 311 of the fixing member 31. The shield member 32 includes a bottom section 321, three connecting holes 322 longitudinally extending through the bottom section 321, and a wall section 323 formed around a periphery of the bottom section 321. The three connecting holes 322, the through hole 222*a* of the cap 22*a*, and the open end of the fuel tank 21*a* are interconnected to each other, and the three metallic wicks 1 are respectively inserted therethrough. Thus, fuel 23 is drawn from the second end 12 to the first end 11 of each of the three metallic wicks 1 via the transport channel 16 by capillary action between the plurality of meshes 15. The bottom section 321 hinders the flame produced at the first end 11 to ignite fuel 23. A diameter of each of the three connecting holes 322 is equal to or bigger than a diameter of the cross section of the metallic wick 1, maintaining the mesh member 10 in its tubular shape. The wall section 323 provides a windproof function.

Figure 12:
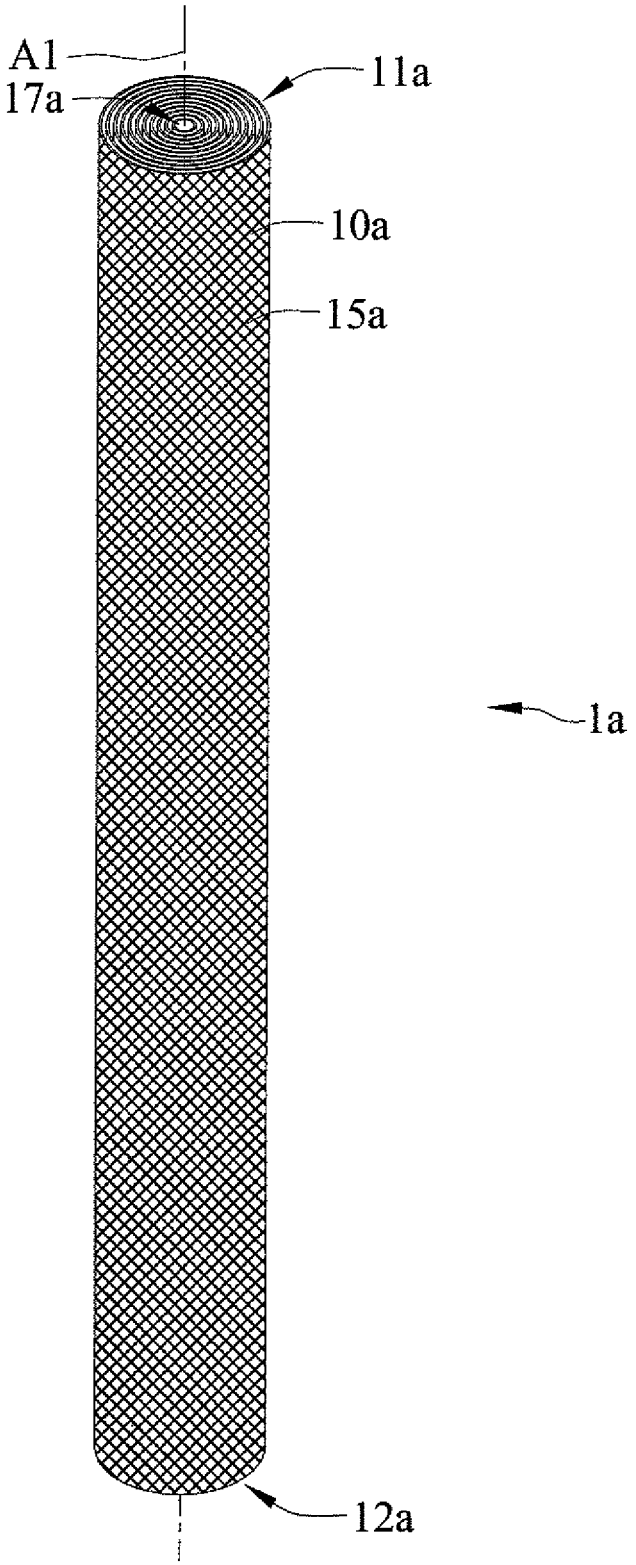
FIG. 12 shows a perspective view of a metallic wick of a second embodiment according to the present invention.
Figure 13:
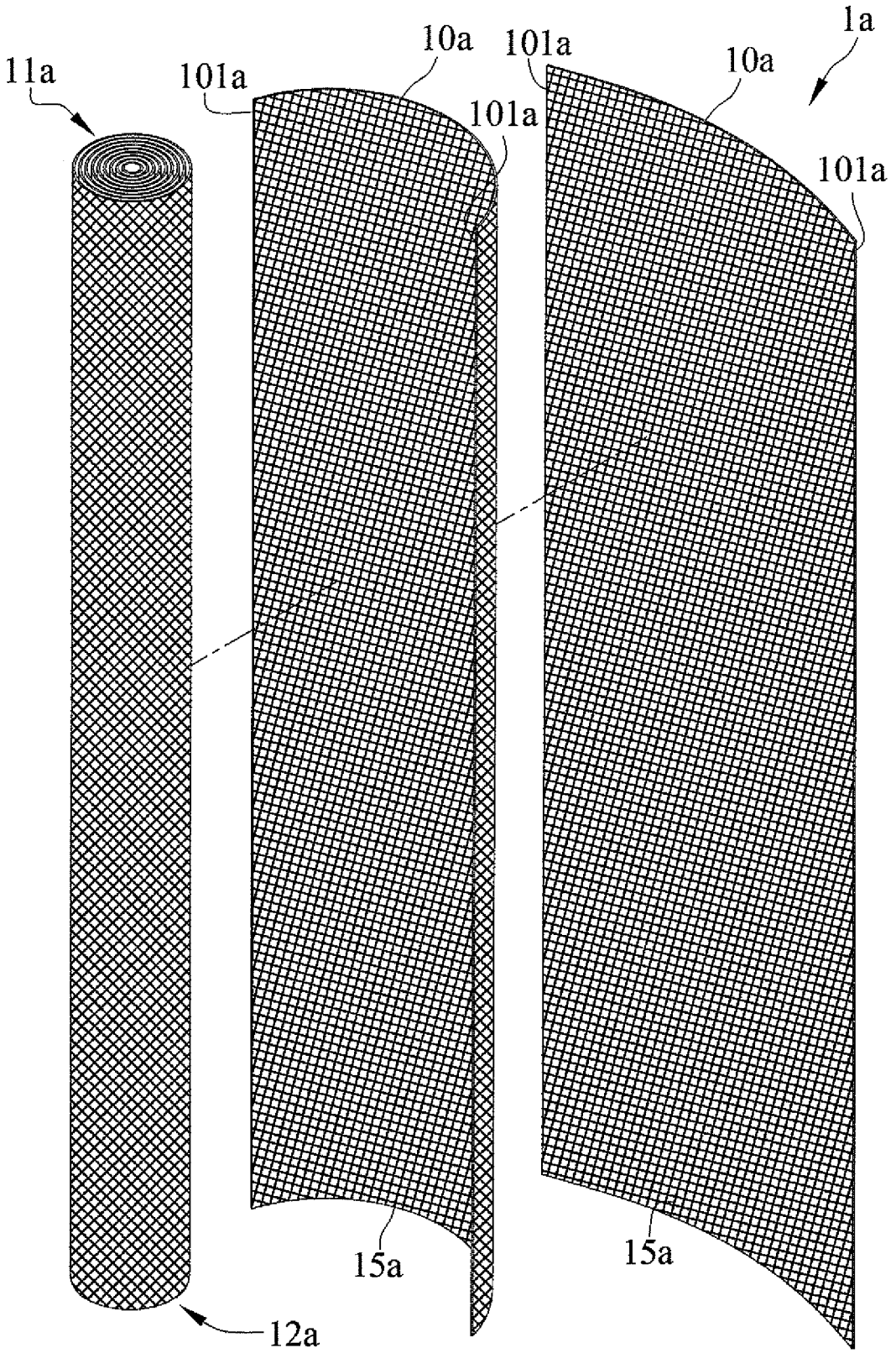
FIG. 13 shows an exploded, perspective view of the metallic wick of FIG. 12.
Figure 14:
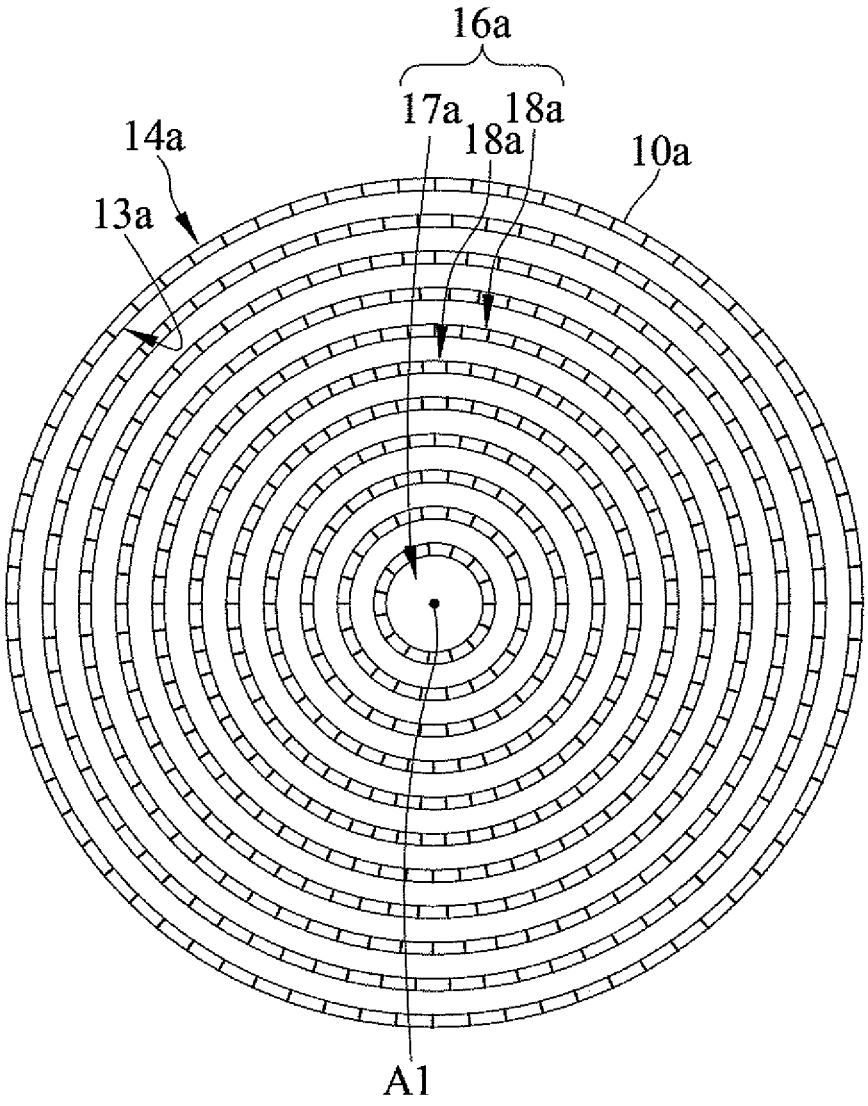
FIG. 14 shows a top view of the metallic wick of FIG. 12.

FIGS. 12 through 14 show a second embodiment of the metallic wick 1*a*. Specifically, the second embodiment of the metallic wick 1*a* includes a plurality of mesh members 10*a* respectively rolled into the plurality of different-sized tubes assembled and radially spaced from each other along a longitudinal axis A1 to form a concentric circular cross section perpendicular to the longitudinal axis A1. Each of the plurality of mesh members 10*a* includes first and second ends 11*a* and 12*a* disposed opposite to each other along the longitudinal axis A1, and first and second surfaces 13*a* and 14*a* respectively extended from the first end 11*a* to the second end 12*a* thereof and arranged opposite to each other. Each of the plurality of mesh members 10*a* further includes two side edges 101*a* extending from the first end 11*a* to the second end 12*a* and connected with each other. Furthermore, each of the plurality of mesh members 10*a* essentially includes a plurality of metallic wires interlacing and overlapping each other to form a plurality of meshes 15*a* penetrating between the first and second ends 11*a* and 12*a* thereof. Each of the plurality of meshes 15*a* is formed in a rhombus shape. Moreover, the plurality of mesh members 10*a* is radially spaced from each other to form a transport channel 16*a* extending from the first end 11*a* to the second end 12*a* thereof along the longitudinal axis A1. The transport channel 16*a* includes a central section 17*a* disposed adjacent to the longitudinal axis A1 and a plurality of annular sections 18*a* surrounding the central section 17*a*. The first surface 13*a* of the innermost one of the plurality of mesh members 10*a* is arranged around the longitudinal axis A1 to form the central section 17*a*. The first and second surfaces 13*a* and 14*a* of the other mesh members 10*a* face and are spaced from each other except the innermost one is defined with the annular sections 18*a*.

Figure 15:
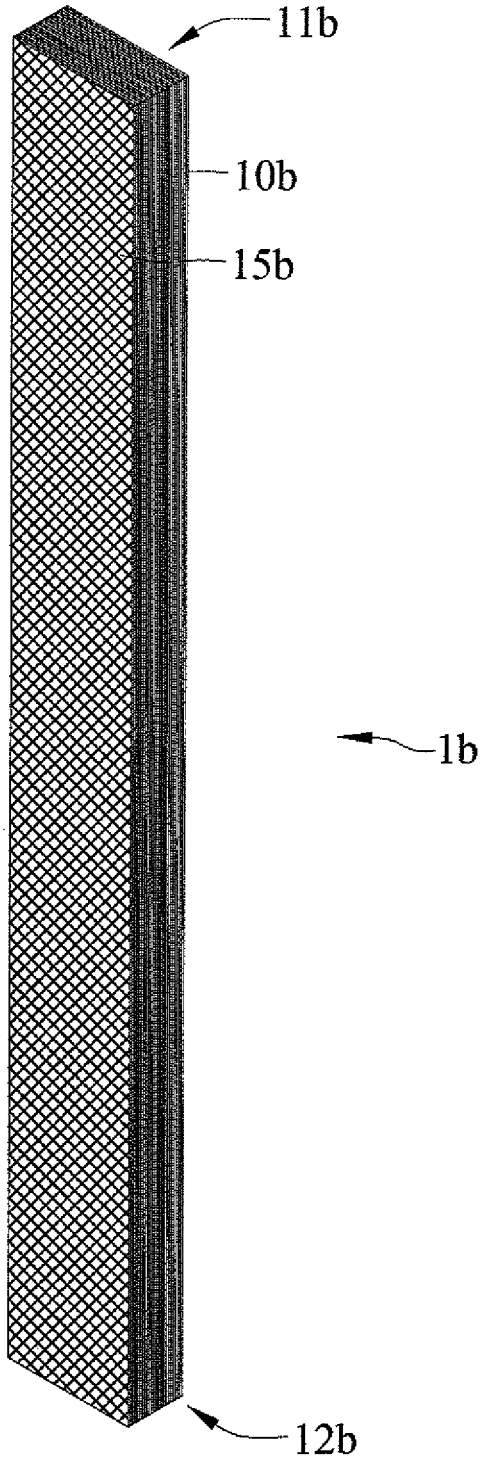
FIG. 15 shows a perspective view of a metallic wick of a third embodiment according to the present invention.
Figure 16:
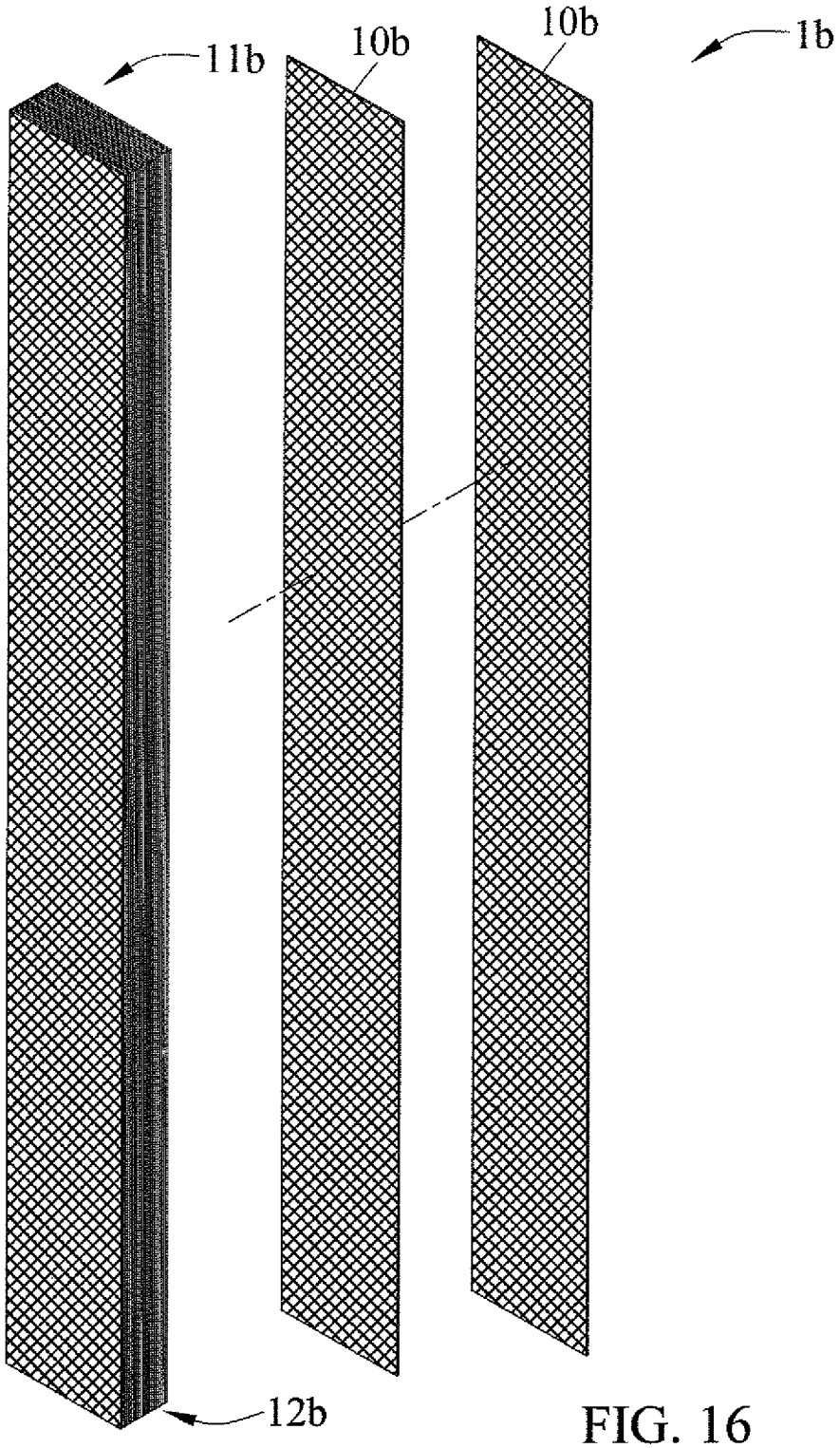
FIG. 16 shows an exploded, perspective view of the metallic wick of FIG. 15.
Figure 17:
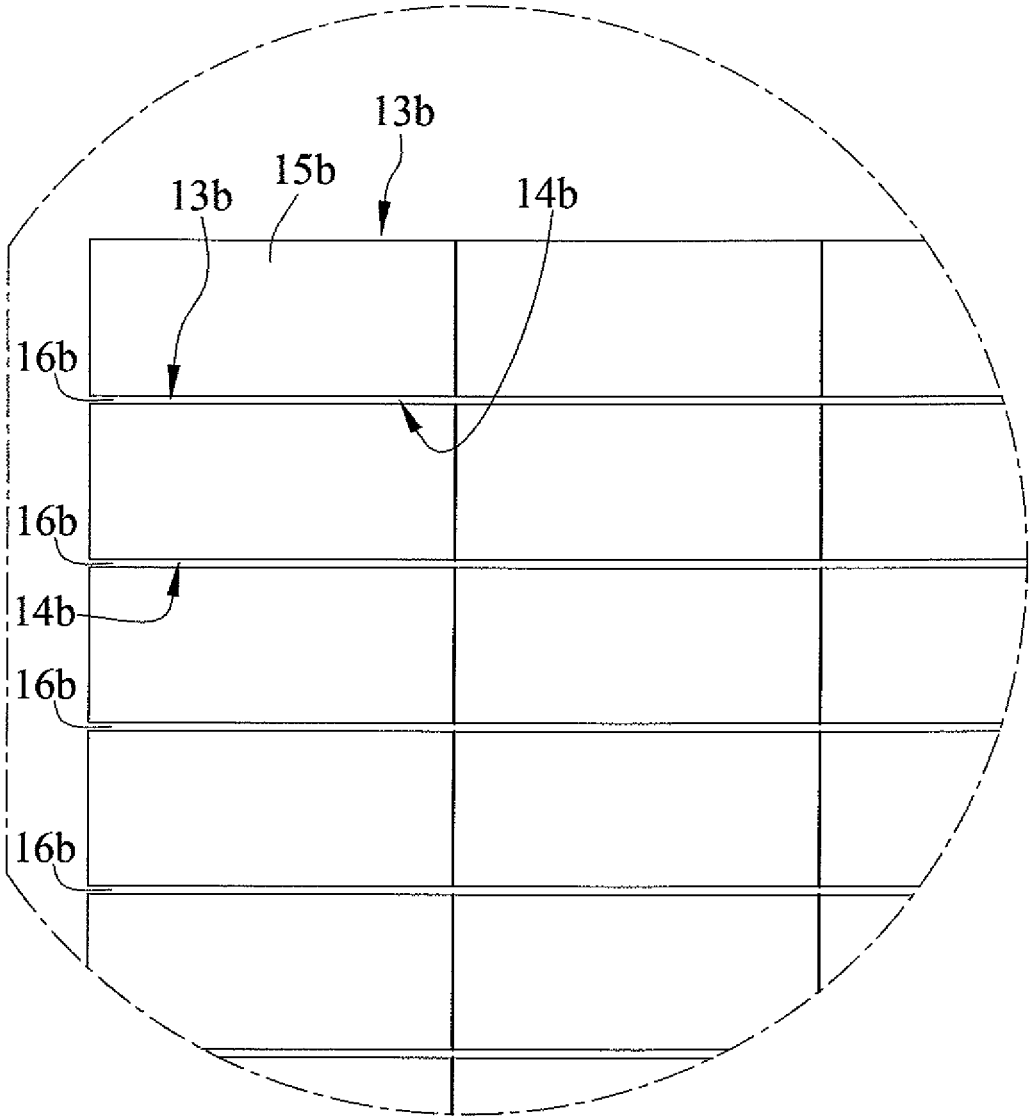
FIG. 17 shows a partial, enlarged side view of FIG. 15.

FIGS. 15 through 17 show a third embodiment of the metallic wick 1*b*. Specifically, the third embodiment of the metallic wick 1*b* includes a plurality of mesh members 10*b* spaced from each other and arranged in a longitudinal stacked array. Each of the plurality of mesh members 10*b* is formed in a flat shape and includes first and second ends 11*b* and 12*b* disposed opposite to each other, and first and second surfaces 13*b* and 14*b* respectively extended from the first end 11*b* to the second end 12*b* thereof and arranged opposite to each other. Furthermore, each of the plurality of mesh members 10*b* essentially includes a plurality of metallic wires interlacing and overlapping each other to form a plurality of meshes 15*b* penetrating between the first and second ends 11*b* and 12*b* thereof. Moreover the plurality of mesh members 10*b* is spaced from each other to form a transport channel 16*b* extending from the first end 11*b* to the second end 12*b* thereof.

Figure 18:
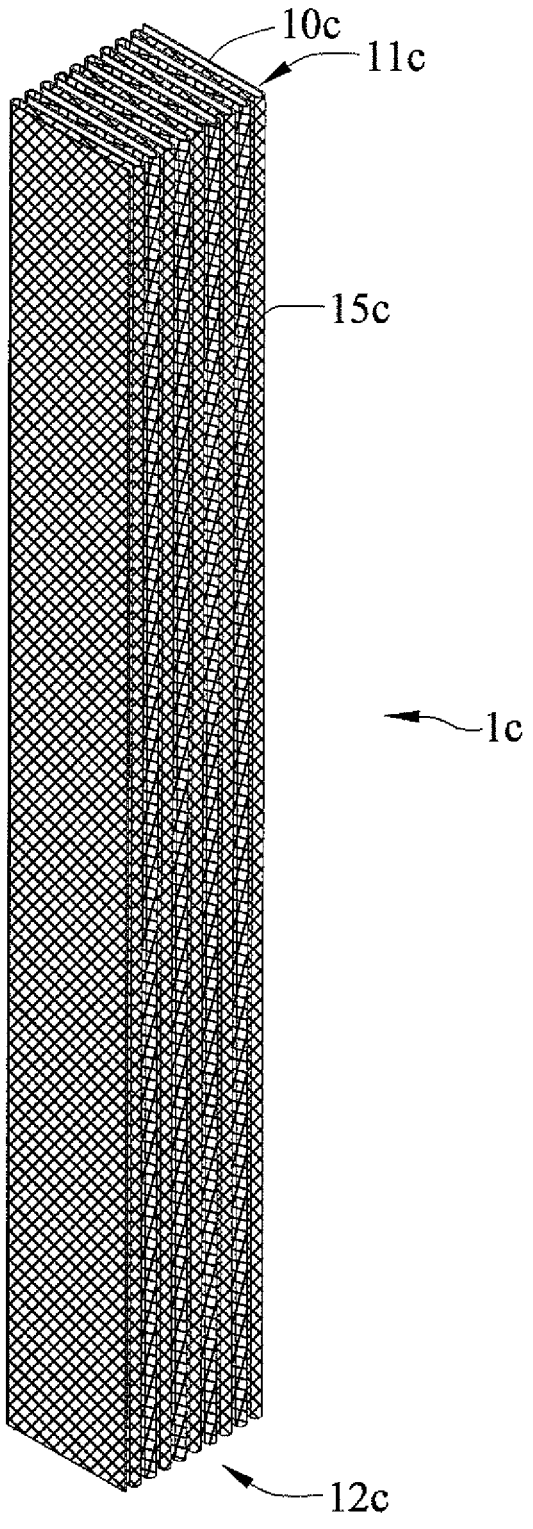
FIG. 18 shows a perspective view of a metallic wick of a fourth embodiment according to the present invention.
Figure 19:
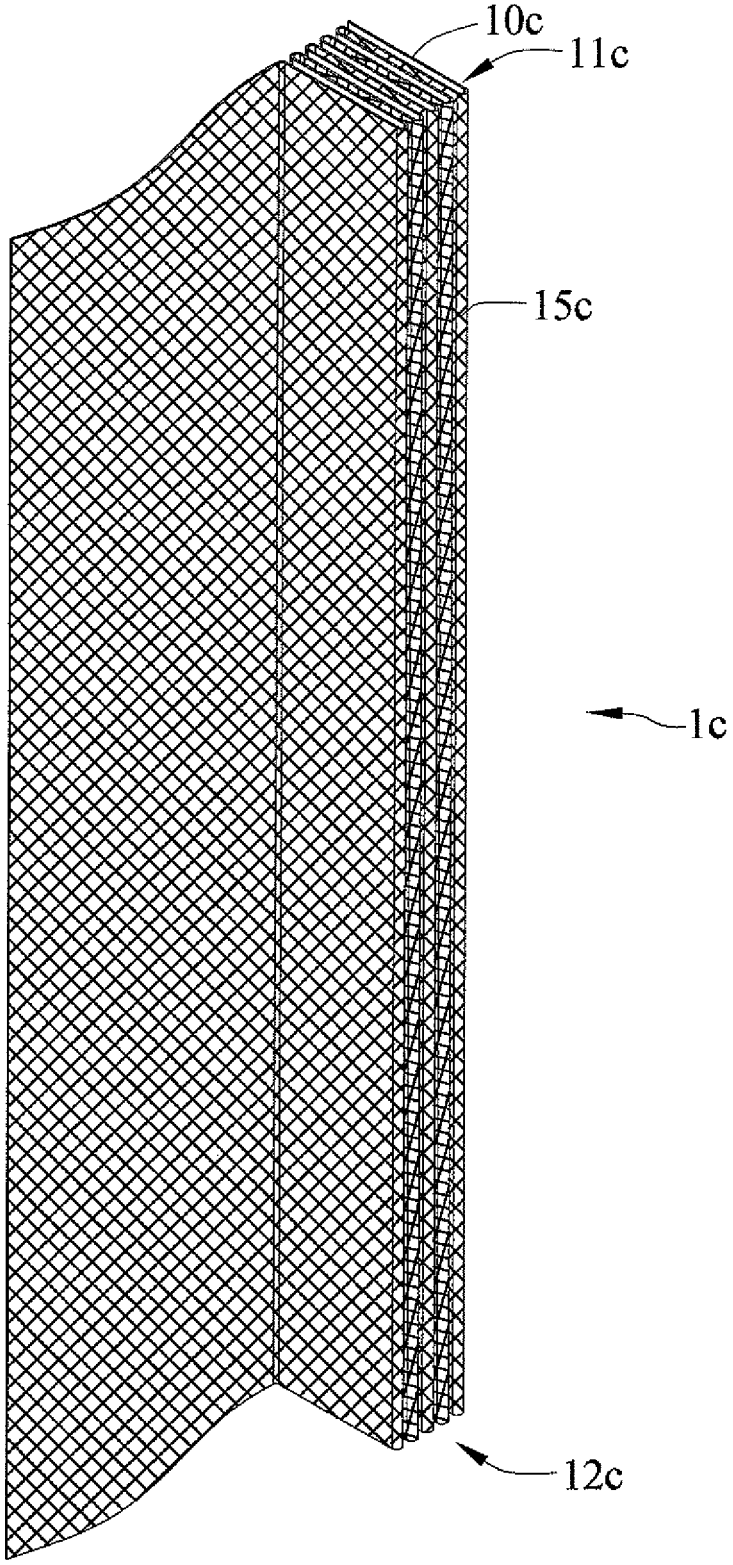
FIG. 19 shows an exploded, perspective view of the metallic wick of FIG. 18.
Figure 20:
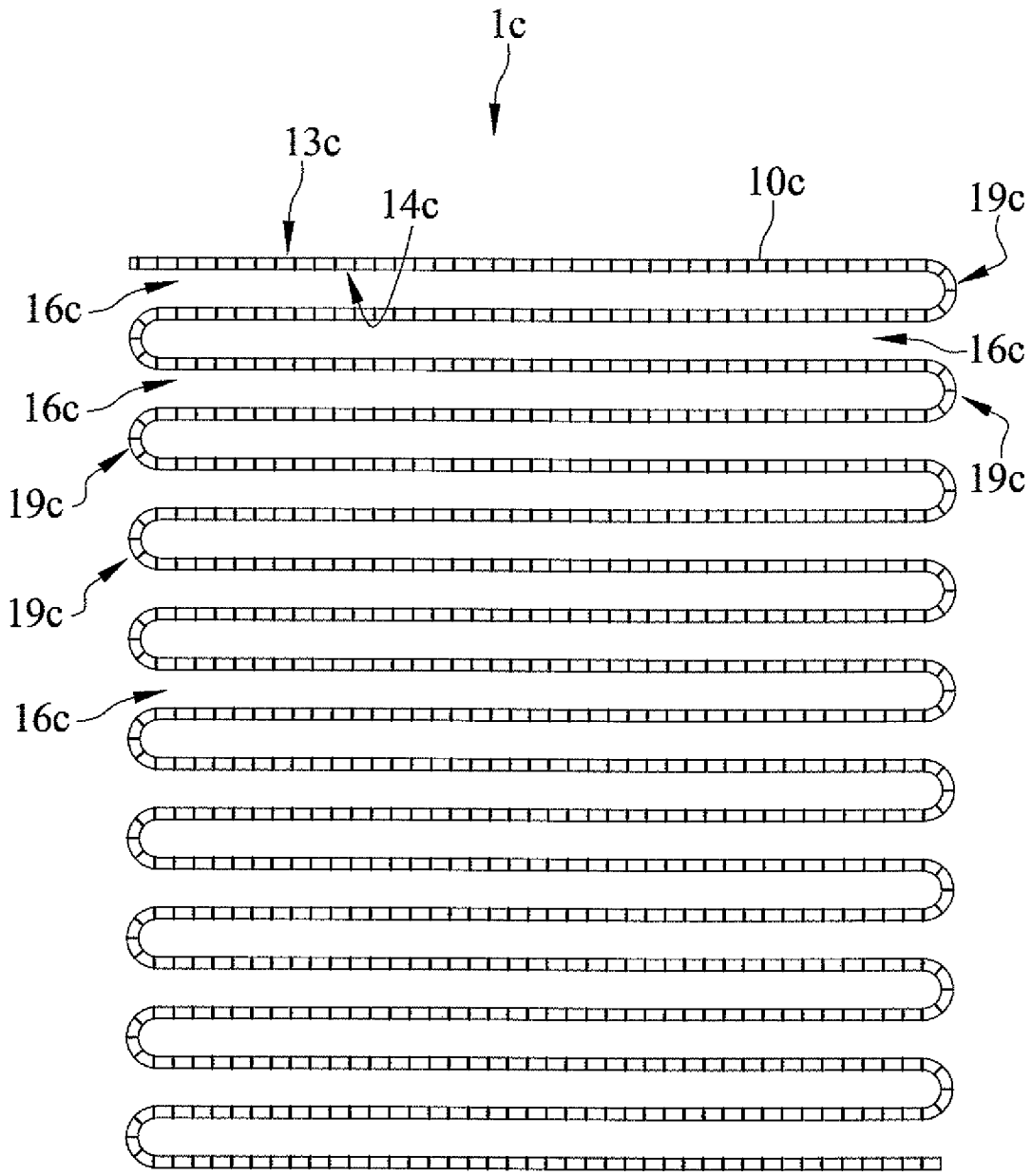
FIG. 20 shows a top view of the metallic wick of FIG. 18.

FIGS. 18 through 20 show a fourth embodiment of the metallic wick 1*c*. Specifically, the fourth embodiment of the metallic wick 1*c* includes a mesh member 10*c* bent to form a stacked array. The mesh member 10*c* includes first and second ends 11*c* and 12*c* disposed opposite to each other, and first and second surfaces 13*c* and 14*c* respectively extended from the first end 11*c* to the second end 12*c* thereof and arranged opposite to each other. Furthermore, the mesh member 10*c* essentially includes a plurality of metallic wires interlacing and overlapping each other to form a plurality of meshes 15*c* penetrating between the first and second ends 11*c* and 12*c* thereof. Moreover, the mesh member 10*c* further includes a plurality of bending sections 19*c*, so that the plurality of bending sections 19*c* and first and second surfaces 13*c* and 14*c* thereof form a transport channel 16*c*.

The metallic wick according to the present invention includes the following advantages:

1. The metallic wick 1; 1*a*; 1*b*; 1*c* is made of metal, so that it cannot be carbonized or consumed, to fix its shape and height thereof to maintain the flame combustion scale.

2. The metallic wick 1; 1*a*; 1*b*; 1*c* includes an end producing the flame thereon and heated by the flame to cause fuel drawn to the end thereof to be vaporized and combusted more completely due to a higher metal wick temperature.

3. The number of circles, the size of meshes 15; 15*a*; 15*b*; 15*c*, the surface roughness and the coating materials of the mesh member 10; 10*a*; 10*b*; 10*c* are adjustable to control the ability of capillary action adapted for wicking various fuels with different viscosity, so that the metallic wick 1; 1*a*; 1*b*; 1*c* can draw more viscous fuel faster to the tip thereof and can be ignited shortly (one minute or less) after dipping the metallic wick 1; 1*a*; 1*b*; 1*c* in fuel.

4. The metallic wick 1; 1*a*; 1*b*; 1*c* does not loosen at its terminal end after cutting a predetermined length or trimming to be mounted on the lamp device 2; 2*a*.

5. The metallic wick 1; 1*a*; 1*b*; 1*c* is made of metal reducing manufacturing costs to provide a popular price. In a preferred form, the metallic wick 1; 1*a*; 1*b*; 1*c* can be formed by a common metal wire mesh.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

What is claimed is:

1. A lamp device comprising:

a metallic wick consisting of at least one mesh member made of metal, with the at least one mesh member having first and second ends disposed opposite to each other, first and second surfaces respectively extended from the first end to the second end thereof and arranged opposite to each other, a plurality of meshes penetrating the first and second surfaces between the first and second ends thereof, and a transport channel communicating with the plurality of meshes and extending from the first end to the second end thereof;

a fuel tank providing a space adapted to store fuel and having an open end adapted to provide an entrance for fuel; and a cap connected to the open end of the fuel tank and includes a bottom portion, a through hole extending through the bottom portion and communicating with the space of the fuel tank, an annular wall portion extending around the bottom portion, and an abutted portion extending away from the bottom portion; and a supporting assembly mounted on the cap, wherein the supporting assembly has a fixing member connected to the bottom portion of the cap and having a through bore communicated with the through hole of the cap, wherein the through hole of the cap and the open end of the fuel tank are interconnected to each other;

wherein the metallic wick is inserted through the cap and contacts with fuel, with fuel to be drawn from the second end to the first end of the at least one mesh member via the transport channel by capillary action to reach a flame produced at the first end of the at least one mesh member, with the abutted portion abutting an outer periphery of the metallic wick to retain the metallic wick, and with the first end inserting through the through bore.

2. The lamp device as claimed in claim 1, wherein the at least one mesh member is rolled and has an Archimedean spiral cross section perpendicular to the longitudinal axis at continuously increasing radial distance from the longitudinal axis to form the transport channel, and wherein the transport channel extends spirally.

3. The lamp device as claimed in claim 2, wherein the transport channel has a closed end at which the first surface is connected with and abutted against the second surface.

4. The lamp device as claimed in claim 1, wherein the at least one mesh member includes a plurality of mesh members disposed concentrically, and wherein the transport channel has a circular cross section perpendicular to the longitudinal axis.

5. The lamp device as claimed in claim 1, wherein the at least one mesh member includes a plurality of mesh members stacked, and wherein the transport channel extends linearly.

6. The lamp device as claimed in claim 1, wherein the at least one mesh member is bent to from a stacked array, and wherein the transport channel extends linearly.

7. The lamp device as claimed in claim 1, wherein the fuel tank and the cap are formed integrally as a single piece, and wherein the cap includes a pull tab removably connected thereto and closing the through hole to avoid fuel leaking out of the fuel tank.

8. The lamp device as claimed in claim 1, a wherein the supporting assembly includes a shield member mounted into the through bore of the fixing member and including a bottom section, a connecting hole extending through the bottom section, and a wall section formed around a periphery of the bottom section, and wherein the connecting hole, the through hole of the cap, and the open end of the fuel tank being interconnected to each other.

9. A lamp device comprising:

a metallic wick consisting of at least one mesh member made of metal, with the at least one mesh member having first and second ends disposed opposite to each other, first and second surfaces respectively extended from the first end to the second end thereof and arranged opposite to each other, a plurality of meshes penetrating the first and second surfaces between the first and second ends thereof, and a transport channel communicating with the plurality of meshes and extending from the first end to the second end thereof;

a fuel tank providing a space adapted to store fuel and having an open end adapted to provide an entrance for fuel;

a cap connected to the open end of the fuel tank and includes a bottom portion, a through hole extending through the bottom portion and communicating with the space of the fuel tank, an annular wall portion extending around the bottom portion, and an abutted portion extending away from the bottom portion; and a supporting assembly including a fixing member and a shield member, with the fixing member connected to the bottom portion of the cap and having a through bore communicated with the through hole of the cap, with the shield member mounted into the through bore of the fixing member and including a bottom section, a connecting hole extending through the bottom section, and a wall section formed around a periphery of the bottom section, with the connecting hole, the through hole of the cap, and the open end of the fuel tank being interconnected to each other;

wherein the metallic wick is inserted through the cap and contacts with fuel, with fuel to be drawn from the second end to the first end of the at least one mesh member via the transport channel by capillary action to reach a flame produced at the first end of the at least one mesh member, and with the abutted portion abutting an outer periphery of the metallic wick to retain the metallic wick; and wherein the at least one mesh member is rolled and has an Archimedean spiral cross section perpendicular to the longitudinal axis at continuously increasing radial distance from the longitudinal axis to form the transport channel, and wherein the transport channel extends spirally.

10. A lamp device comprising:

a metallic wick consisting of at least one mesh member made of metal, with the at least one mesh member having first and second ends disposed opposite to each other, first and second surfaces respectively extended from the first end to the second end thereof and arranged opposite to each other, a plurality of meshes penetrating the first and second surfaces between the first and second ends thereof, and a transport channel communicating with the plurality of meshes and extending from the first end to the second end thereof;

a fuel tank providing a space adapted to store fuel and having an open end adapted to provide an entrance for fuel;

a cap connected to the open end of the fuel tank and includes a bottom portion, a through hole extending through the bottom portion and communicating with the space of the fuel tank, an annular wall portion extending around the bottom portion, and an abutted portion extending away from the bottom portion; and a supporting assembly including a fixing member and a shield member, with the fixing member connected to the bottom portion of the cap and having a through bore communicated with the through hole of the cap, with the shield member mounted into the through bore of the fixing member and including a bottom section, a connecting hole extending through the bottom section, and a wall section formed around a periphery of the bottom section, with the connecting hole, the through hole of the cap, and the open end of the fuel tank being interconnected to each other;

wherein the metallic wick is inserted through the cap and contacts with fuel, with fuel to be drawn from the second end to the first end of the at least one mesh member via the transport channel by capillary action to reach a flame produced at the first end of the at least one mesh member, and with the abutted portion abutting an outer periphery of the metallic wick to retain the metallic wick; and wherein the at least one mesh member includes a plurality of mesh members disposed concentrically, and wherein the transport channel has a circular cross section perpendicular to the longitudinal axis.

11. A lamp device comprising:

a metallic wick consisting of at least one mesh member made of metal, with the at least one mesh member having first and second ends disposed opposite to each other, first and second surfaces respectively extended from the first end to the second end thereof and arranged opposite to each other, a plurality of meshes penetrating the first and second surfaces between the first and second ends thereof, and a transport channel communicating with the plurality of meshes and extending from the first end to the second end thereof;

a fuel tank providing a space adapted to store fuel and having an open end adapted to provide an entrance for fuel;

a cap connected to the open end of the fuel tank and includes a bottom portion, a through hole extending through the bottom portion and communicating with the space of the fuel tank, an annular wall portion extending around the bottom portion, and an abutted portion extending away from the bottom portion; and a supporting assembly including a fixing member and a shield member, with the fixing member connected to the bottom portion of the cap and having a through bore communicated with the through hole of the cap, with the shield member mounted into the through bore of the fixing member and including a bottom section, a connecting hole extending through the bottom section, and a wall section formed around a periphery of the bottom section, with the connecting hole, the through hole of the cap, and the open end of the fuel tank being interconnected to each other;

wherein the metallic wick is inserted through the cap and contacts with fuel, with fuel to be drawn from the second end to the first end of the at least one mesh member via the transport channel by capillary action to reach a flame produced at the first end of the at least one mesh member, and with the abutted portion abutting an outer periphery of the metallic wick to retain the metallic wick; and wherein the at least one mesh member includes a plurality of mesh members stacked, and wherein the transport channel extends linearly.

12. A lamp device comprising:

a metallic wick consisting of at least one mesh member made of metal, with the at least one mesh member having first and second ends disposed opposite to each other, first and second surfaces respectively extended from the first end to the second end thereof and arranged opposite to each other, a plurality of meshes penetrating the first and second surfaces between the first and second ends thereof, and a transport channel communicating with the plurality of meshes and extending from the first end to the second end thereof;

a fuel tank providing a space adapted to store fuel and having an open end adapted to provide an entrance for fuel;

a cap connected to the open end of the fuel tank and includes a bottom portion, a through hole extending through the bottom portion and communicating with the space of the fuel tank, an annular wall portion extending around the bottom portion, and an abutted portion extending away from the bottom portion; and a supporting assembly including a fixing member and a shield member, with the fixing member connected to the bottom portion of the cap and having a through bore communicated with the through hole of the cap, with the shield member mounted into the through bore of the fixing member and including a bottom section, a connecting hole extending through the bottom section, and a wall section formed around a periphery of the bottom section, with the connecting hole, the through hole of the cap, and the open end of the fuel tank being interconnected to each other;

wherein the metallic wick is inserted through the cap and contacts with fuel, with fuel to be drawn from the second end to the first end of the at least one mesh member via the transport channel by capillary action to reach a flame produced at the first end of the at least one mesh member, and with the abutted portion abutting an outer periphery of the metallic wick to retain the metallic wick; and wherein the at least one mesh member is bent to from a stacked array, and wherein the transport channel extends linearly.

* * * * *